US011384723B2

(12) United States Patent
Kirchberger

(10) Patent No.: US 11,384,723 B2
(45) Date of Patent: Jul. 12, 2022

(54) TWO-STROKE INTERNAL COMBUSTION ENGINE

(71) Applicant: Roland Kirchberger, Graz (AT)

(72) Inventor: Roland Kirchberger, Graz (AT)

( * ) Notice: Subject to any disclaimer, the term of this patent is extended or adjusted under 35 U.S.C. 154(b) by 20 days.

(21) Appl. No.: 16/083,866

(22) PCT Filed: Mar. 7, 2017

(86) PCT No.: PCT/AT2017/050005

§ 371 (c)(1),
(2) Date: Sep. 10, 2018

(87) PCT Pub. No.: WO2017/152200

PCT Pub. Date: Sep. 14, 2017

(65) Prior Publication Data

US 2019/0078545 A1 Mar. 14, 2019

(30) Foreign Application Priority Data

Mar. 10, 2016 (AT) ..... A 50200/2016

(51) Int. Cl.
*F02M 61/18* (2006.01)
*F02B 25/18* (2006.01)
(Continued)

(52) U.S. Cl.
CPC ..... *F02M 61/1853* (2013.01); *F02B 25/18* (2013.01); *F02B 75/02* (2013.01);
(Continued)

(58) Field of Classification Search
CPC . F02M 61/1853; F02B 25/18; F02B 2710/03; F02B 75/16
(Continued)

(56) References Cited

U.S. PATENT DOCUMENTS 5,329,902 A 7/1994 Sakamoto et al.
5,740,767 A * 4/1998 Kaku ..... F02B 25/16 123/65 W
(Continued)

FOREIGN PATENT DOCUMENTS

AT 503127 A4 8/2007
DE 19636396 A1 3/1998
(Continued)

OTHER PUBLICATIONS

Espacenet. English Language Abstract for DE 196 39 396 A1, Mar. 12, 1998, Robert Bosch GmbH.
(Continued)

*Primary Examiner* — Lindsay M Low
*Assistant Examiner* — Omar Morales
(74) *Attorney, Agent, or Firm* — Tiajoloff & Kelly LLP

(57) ABSTRACT

A two-stroke internal combustion engine has at least one cylinder (1) receiving a piston (2) and having at least one injection nozzle (4) in the form of a multi-hole low-pressure nozzle inserted in a bore (5) in the cylinder jacket (6). The multi-hole low-pressure nozzle has a nozzle plate (15) with nozzle openings (16) arranged within an enveloping circle (17) to form a common nozzle jet (11) with an opening angle (α) dependent on the inclination of the nozzle axis (12) relative to the orifice surface of the bore and preventing the nozzle jet from being applied to the cylinder jacket. A resulting vector (14) from the velocity vector (13) of the nozzle jet in the direction of the nozzle axis (12) and the velocity vector (10) of the flushing air flow in the flow main direction defines with the cylinder jacket a maximum inclination angle (γ) of 20°.

4 Claims, 2 Drawing Sheets

Figure 1:
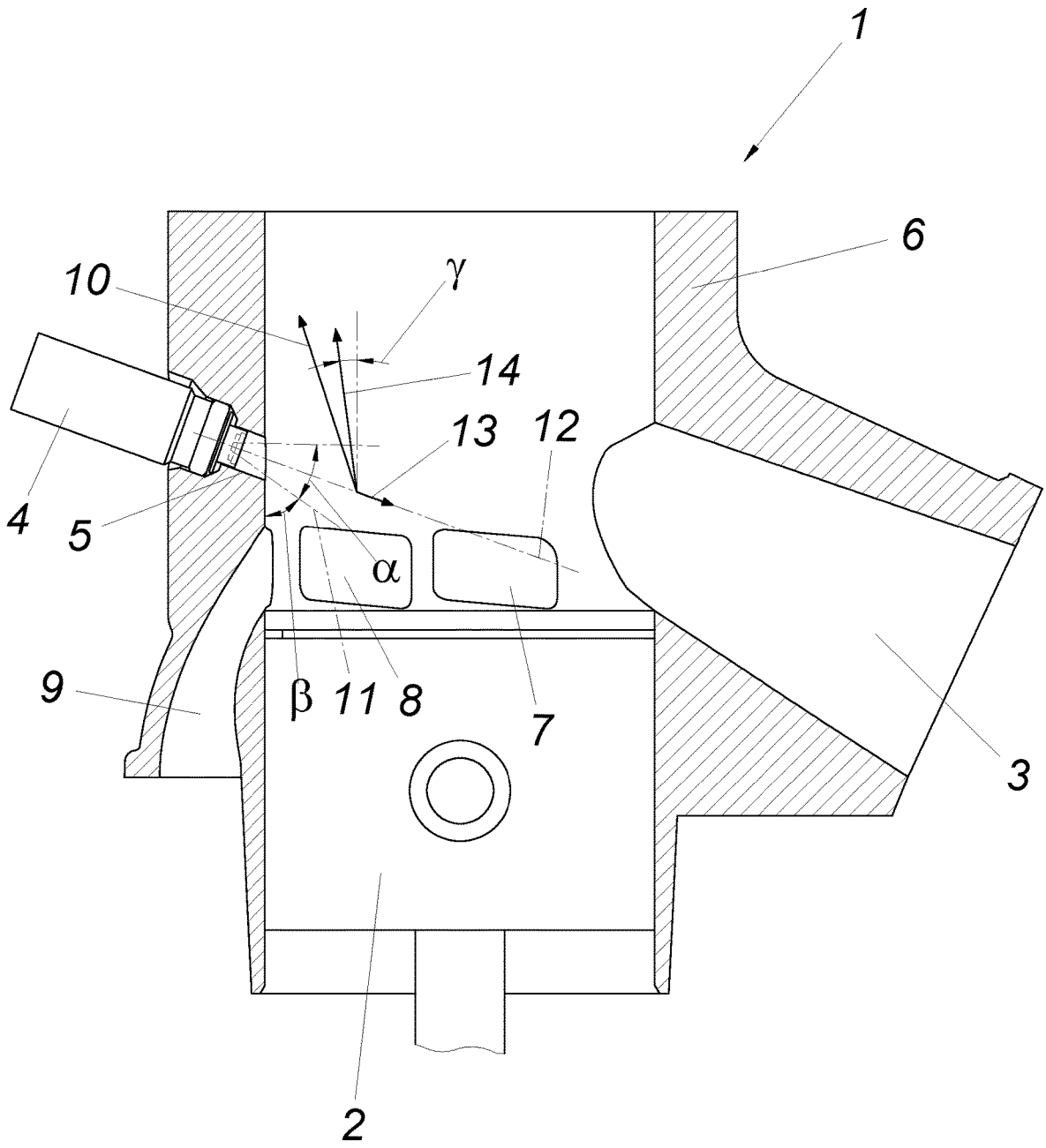

(51) Int. Cl.
*F02B 75/02* (2006.01)
*F02B 75/16* (2006.01)

(52) U.S. Cl.
CPC ..... *F02B 75/16* (2013.01); *F02B 2075/023* (2013.01); *F02B 2710/03* (2013.01)

(58) Field of Classification Search
USPC ..... 123/65 R
See application file for complete search history.

(56) References Cited

U.S. PATENT DOCUMENTS

| | | | | |
|---|---|---|---|---|
| 6,109,223 | A * | 8/2000 | Motoyama | F02B 33/04 123/73 A |
| 6,468,122 | B1 | 10/2002 | Clements et al. | |
| 2003/0084883 | A1* | 5/2003 | Parrish | F02B 61/045 123/500 |
| 2011/0220059 | A1* | 9/2011 | Ganglmayr | F02F 1/22 123/299 |

FOREIGN PATENT DOCUMENTS

| | | | |
|---|---|---|---|
| WO | 2010/063048 | A1 | 6/2010 |
| WO | 2015/113096 | A1 | 8/2015 |

OTHER PUBLICATIONS

Espacenet. English Language Abstract for WO2015/113096, Aug. 6, 2015, Roland Kirchberger.

* cited by examiner

TWO-STROKE INTERNAL COMBUSTION ENGINE

FIELD OF THE INVENTION

The invention refers to a two-stroke internal combustion engine having at least one cylinder (1) receiving a piston (2) and having at least one injection nozzle (4) in the form of a multi-hole low-pressure nozzle inserted in a bore (5) in the cylinder jacket (6).

DESCRIPTION OF THE PRIOR ART

Since the time available within the cycles is not sufficient to evaporate the fuel injected against the hot piston crown with the aid of injection nozzles and thus the disadvantages of the piston and cylinder wall surfaces wetted with fuel become relevant, especially with regard to hydrocarbon emissions, it has already been proposed (WO 2010/063048 A1) to arrange the injection nozzles symmetrically opposite one another with respect to a diameter plane of the cylinder determined by the axis of an outlet channel, such that nozzle axes intersect in the diameter plane in the lower dead center position of the piston above the piston crown, namely on the side of the cylinder axis facing away from the outlet channel, which in conjunction with the opposing air flow through the overflow channels leads to a flow of the forming mixture directed away from the piston crown towards the cylinder head and therefore prevents the piston crown from being wetted with fuel leading to hydrocarbon emissions. However, this effect is only undermined by an injection nozzle during fuel injection. Therefore, the use of multi-hole low-pressure nozzles was proposed (WO 2015/113096 A1), which inject the fuel with reduced momentum.

However, the impulse of the injection jet disrupts the flushing flow of the fresh air, especially at low loads, so that a comparatively large fresh air front running through the cylinder cannot form for the desired displacement flushing. Since the influence of the fuel injection on this fresh air front is reduced with a corresponding fuel distribution over the fresh air front, a fuel distribution over a comparatively large area must be aimed for, which not only increases the impulse but also requires a larger opening angle of the nozzle jet with the risk that the nozzle jet will be applied to the cylinder wall.

Injection nozzles with a multi-hole plate are known from DE 19636396 A1, for example. However, such known injection nozzles cannot rule out the risk that the fuel-air mixture may be applied to the cylinder wall after the nozzle jet has been merged with the air flow.

DESCRIPTION OF THE INVENTION

The invention is thus based on the object of improving the injection conditions for a two-stroke internal combustion engine in such a way that the injection of the fuel into the combustion chamber disturbs the flushing flow above the piston only slightly and avoids the risk that the fuel-air mixture will be applied to the cylinder wall after the nozzle jet has been merged with the air flow and the cylinder wall is thus wetted with fuel.

Based on a two-stroke internal combustion engine of the type described above, the invention solves the problem in that the multi-hole low-pressure nozzle has a nozzle plate with nozzle openings arranged within an enveloping circle to form a common nozzle jet with an opening angle which is dependent on the inclination of the nozzle axis with respect to the orifice surface of the bore and which prevents the nozzle jet from being applied to the cylinder jacket, and in that in the case of a vector which is inclined relative to the cylinder jacket resulting from the velocity vector of the nozzle jet in the direction of the nozzle axis and the velocity vector of the flushing air flow in the flow main direction, the resulting vector with the cylinder jacket has a maximum inclination angle of 20°.

Due to these measures, a cross-sectional area of the nozzle jet can be achieved at a comparatively small opening angle of the common nozzle jet at a predetermined distance from the injection nozzle, which cross-sectional area requires either a considerably larger opening angle of the nozzle jet or a larger distance from the injection nozzle compared to a nozzle jet of a single-hole nozzle. The nozzle openings arranged within an enveloping circle result in a nozzle jet whose outlet cross-section is determined not by the diameter of the nozzle openings but by the enveloping circle diameter surrounding the nozzle openings, which reduces the distance from the injection nozzle at a predetermined cross-sectional area, so that the opening angle of the nozzle jet can be limited at a predetermined distance without having to do without a corresponding distribution of the injected fuel over a larger cross-sectional area. This means, on the one hand, that due to the injection of the fuel via several nozzle holes arranged within an enveloping circle, the fuel is injected into the combustion chamber with a comparatively small impulse in a good distribution via the front of the air flow and that, on the other hand, due to the limited opening angle, the risk of the nozzle jet being applied to the cylinder wall can be excluded, which is an essential prerequisite for an advantageous fuel distribution in the combustion chamber. In addition, there is no risk that the fuel-air mixture will be applied to the cylinder wall after the nozzle jet has merged with the air flow.

The number of nozzle openings and their orientation can easily influence the formation of the nozzle jet. If the nozzle plate has at least three nozzle openings distributed over the circumference of the enveloping circle, a basis for the nozzle jet, determined by the diameter of the enveloping circle, results in the case of a common nozzle jet, which meets many requirements. Particularly advantageous design conditions result in this connection if the enveloping circle of the nozzle openings has a diameter which corresponds to at least one third of the radius of the bore in the cylinder jacket which receives the injection nozzle.

BRIEF DESCRIPTION OF THE INVENTION

Figure 2:
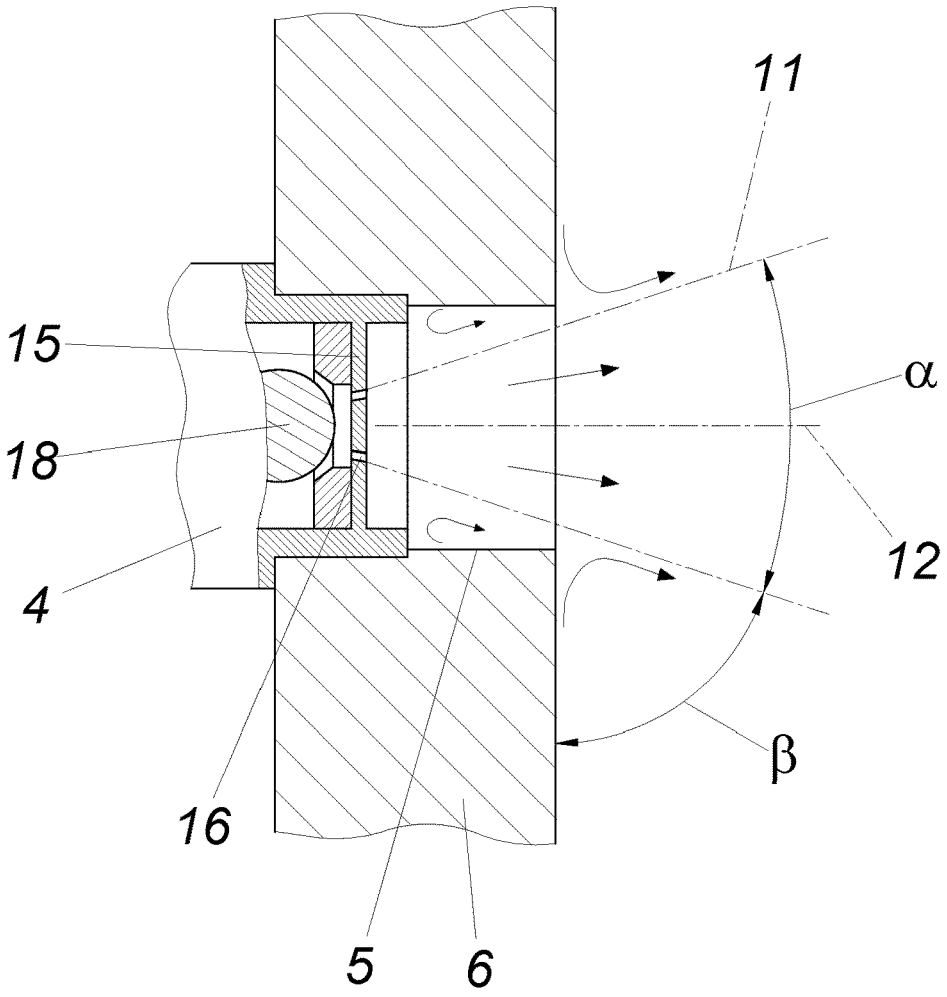
Figure 3:
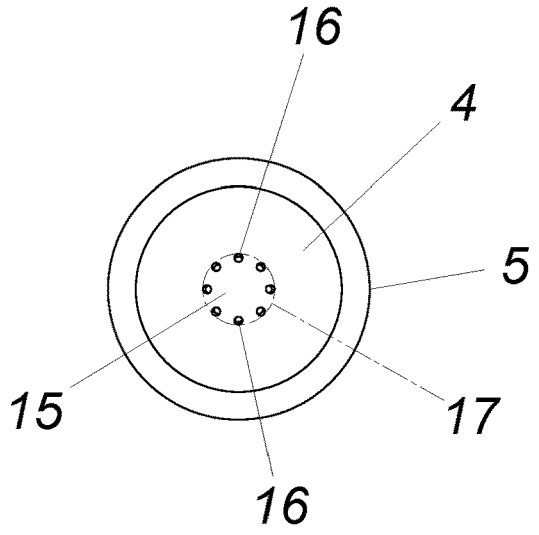

In the drawing, for example, the subject matter of the invention is shown, wherein:

FIG. 1 shows a two-stroke internal combustion engine according to the invention in sections in an axial section through a cylinder, FIG. 2 shows an injection nozzle inserted into a bore in the cylinder jacket and exposed in the area of the nozzle plate on a larger scale, and FIG. 3 shows the injection nozzle according to FIG. 2 inserted into the bore in a front view.

DETAILED DESCRIPTION OF THE PREFERRED EMBODIMENTS

According to FIG. 1, a two-stroke internal combustion engine according to the invention comprises at least one cylinder 1 with a piston 2, which is shown in the lower dead center position. An injection nozzle 4 is provided on the cylinder side opposite an outlet channel 3, which is inserted into a bore 5 in the cylinder jacket 6. Between the crankcase (not shown) and the combustion chamber of the cylinder 1, overflow channels 7, 8 are disposed opposite each other in pairs with respect to the drawing plane. In addition, the cylinder 1 has an overflow channel diametrically opposed to outlet channel 3 as an upright channel 9. The flushing air flow caused by the overflow channels 7, 8 and the upright channel 9 has a velocity vector 10 in the direction of the resulting main air flow. The fuel is injected into the combustion chamber in the form of a nozzle jet 11 in the direction of the nozzle axis 12. The velocity vector of the nozzle jet in the direction of the nozzle axis 12 is marked with reference numeral 13. The velocity vector 13 of the nozzle jet 11 forms a resulting vector 14 with the velocity vector 10 of the flushing air flow, which vector 14 is decisive for the total flow resulting from the flushing air flows and the nozzle jet 11 and illustrates the flow path of the fuel-air mixture in the combustion chamber.

The front surface of the flushing air flow should undergo as little change as possible in its course by the nozzle jet 11 in order to be able to create a good displacement purge. For this reason, the fuel should be fed as evenly as possible into the air flow via the flushing air front. In the area where the flushing air stream and nozzle jet 11 meet, this requires a cross-sectional area of nozzle jet 11 adapted to the flushing air front on the one hand and a comparatively small impulse of the nozzle jet 11 on the other. Despite these conditions, the nozzle jet should not be applied to the cylinder jacket 6 due to a Coanda effect. This means that the opening angle $\alpha$ of the nozzle jet 11 must remain limited with regard to the inclination angle of the nozzle axis 12 in relation to the cylinder axis in order not to fall below the application angle decisive for the Coanda effect. According to FIG. 1, at the given opening angle $\alpha$ the smallest angle $\beta$ between the jacket of the nozzle jet 11 and the cylinder jacket 6 must therefore not fall below the application angle. On the other hand, this means that the opening angle $\alpha$ of the nozzle jet 11 must be limited accordingly if the nozzle axis 12 has a given angle of inclination.

In order to meet these different requirements with simple constructional means, the injection nozzle 4 is designed in the form of a multi-hole low-pressure nozzle with a nozzle plate 15, whose nozzle openings 16 are arranged within an enveloping circle 17 in such a way that the individual nozzle jets merge into a common nozzle jet 11, whose opening angle $\alpha$ can be specified by the orientation of the nozzle openings 16. If, according to FIG. 2, the injection valve 4 is opened by applying pressure to the valve body 18, the fuel is injected into the combustion chamber through the nozzle openings 16 with a comparatively low impulse in the form of nozzle jet 11 and hits the resulting flushing air flow there in order to distribute itself finely in this air flow without disturbing the flushing air flow. According to FIG. 1, the fuel-air mixture is guided away from the piston crown upwards against the cylinder head in accordance with the flow conditions, wherein the velocity vectors 10, 13 determine the flow path for the air flow on the one hand and for the nozzle jet 11 of the injected fuel on the other hand. This flow path of the fuel-air mixture should not be applied to the cylinder jacket 6 to prevent the cylinder jacket 6 from being wetted with fuel. This is successful if, with a resulting vector 14 inclined against the cylinder jacket 6, the angle of inclination $\gamma$ of this vector 14 relative to the cylinder jacket 6 is at most 20°.

The invention claimed is:

1. A two-stroke internal combustion engine comprising:

a cylinder having a cylinder jacket having a bore therein;

said cylinder receiving a piston and having at least one injection nozzle comprising a multi-hole low-pressure nozzle inserted in the bore in the cylinder jacket;

said cylinder during operation of the engine receiving air therein from one or more channels in a flushing airflow that flows in a main flow direction adjacent the bore in the cylinder jacket;

wherein the multi-hole low-pressure nozzle comprises a nozzle plate with nozzle openings arranged within an enveloping circle so as to form a common nozzle jet;

said nozzle jet injecting fuel into the cylinder at a nozzle-jet velocity with an opening angle ($\alpha$) of injected fuel that is dependent on an inclination of a nozzle axis relative to an orifice surface of the bore;

wherein the nozzle is positioned above the one or more channels and injects fuel into the cylinder only above the piston, and the opening angle ($\alpha$) is angled away from the cylinder jacket by an angle great enough that fuel injected by the nozzle jet is prevented from being applied to the cylinder jacket; and wherein the nozzle is supported in a position and orientation such that a velocity vector of the nozzle jet velocity in a direction of the nozzle axis combined with a velocity vector of the flushing air flow in the main flow direction results in a resulting vector for a total flow of a fuel-air mixture from the fuel injected by the nozzle jet and the airflow that is at an inclination angle ($\gamma$) relative to the cylinder jacket that is not greater than 20°.

2. A two-stroke internal combustion engine according to claim 1, wherein the nozzle plate has at least three nozzle openings distributed over the circumference of the enveloping circle.

3. A two-stroke internal combustion engine according to claim 2, wherein the enveloping circle of the nozzle openings has a diameter corresponding to at least one third of a radius of the bore in the cylinder jacket receiving the injection nozzle.

4. A two-stroke internal combustion engine according to claim 1, wherein the enveloping circle of the nozzle openings has a diameter corresponding to at least one third of a radius of the bore in the cylinder jacket receiving the injection nozzle.

* * * * *